US006429175B1

(12) United States Patent
Stuart, Jr. et al.

(10) Patent No.: US 6,429,175 B1
(45) Date of Patent: Aug. 6, 2002

(54) LUBRICATING GREASE COMPOSITION

(75) Inventors: James A. Stuart, Jr., Hartland, WI (US); Douglas A. Wallace, Mount Prospect, IL (US)

(73) Assignee: New Age Chemical, Inc., Delafield, WI (US)

( * ) Notice: Subject to any disclaimer, the term of this patent is extended or adjusted under 35 U.S.C. 154(b) by 0 days.

(21) Appl. No.: 09/716,879

(22) Filed: Nov. 20, 2000

(51) Int. Cl.[7] ..... C10M 169/00

(52) U.S. Cl. ..... 508/144; 508/136; 508/150; 508/165; 508/180; 508/181; 508/385; 508/459; 508/491; 508/539

(58) Field of Search ..... 508/136, 150, 508/144

(56) References Cited

U.S. PATENT DOCUMENTS 5,385,683 A 1/1995 Ransom ..... 252/35
5,576,273 A 11/1996 Karol et al. ..... 508/364
5,631,214 A * 5/1997 Karol et al. ..... 508/365
5,650,380 A * 7/1997 Fletcher ..... 508/168
5,786,307 A 7/1998 Igarashi et al. ..... 508/465
5,840,664 A * 11/1998 Karol et al. ..... 508/283
6,090,755 A * 7/2000 Wan et al. ..... 508/108

* cited by examiner

*Primary Examiner*—Ellen M. McAvoy
(74) *Attorney, Agent, or Firm*—Andrus, Sceales, Starke & Sawall, LLP

(57) ABSTRACT

A lubricating grease composition including the combination of an oil base, a thickener, and bismuth preferably in the form of a bismuth carboxylate. The grease has excellent film strength, improved "anti-washout" capabilities, and, depending on the thickener used, may have no dropping point, meaning that the oil will not separate out at elevated temperatures.

17 Claims, No Drawings

LUBRICATING GREASE COMPOSITION

BACKGROUND OF THE INVENTION

Food grade lubricating greases are used on machinery or equipment in the food manufacturing and processing industries. It is desirable that a food grade grease have high extreme pressure characteristics, meaning that the grease film located between the operating components of the machinery is capable of withstanding high pressures before rupturing. A food grade grease should also have good "anti-washout" properties, meaning that the grease will not readily wash away with the sanitizing solution which is used to wash down the equipment after each day's run. In addition, it is desirable that a food grade grease be environmentally friendly. In the past, the conventional food grade grease has not met this criteria for the usual food grade grease has relatively low extreme pressure characteristics and does not have high "anti-washout" properties, thus requiring that the equipment be frequently re-lubricated.

It is known to add bismuth compounds such as bismuth carboxylates to lubricating oils. For example, U.S. Pat. No. 5,385,683 describes a lubricating oil composition containing a bismuth carboxylate, such as bismuth neodecanoate or bismuth 2-ethylhexanoate, along with a tin carboxylate. The patent states that at high temperatures the bismuth and tin compounds dissociate to form a bismuth-tin alloy that coats the working part.

U.S. Pat. No. 5,576,273 discloses a lubricating oil composition containing a bismuth carboxylate along with a dihydrocarbyidithiocarbamate. This combination is stated to produce improved extreme pressure properties for the lubricating oil. It is also known to incorporate a bismuth carboxylate and a carboxylic acid in lubricating oil compositions to improve the physical properties of the oil.

SUMMARY OF THE INVENTION

The invention is directed to a lubricating grease composition and in particular to a food grade grease composition.

In general, the grease composition includes an oil base, a thickener, and bismuth, preferably in the form of a bismuth carboxylate.

The thickener is preferably bentonite clay, although other thickeners, such as lithium soap, an aluminum or calcium complex or polyurea can also be employed. When dealing with a food grade grease, the oil base can take the form of a vegetable oil such as soy bean oil, canola, palm oil, or the like.

In addition, the grease composition can also include small amounts of anti-oxidants or preservative, corrosion inhibitors, fillers, whiteners and/or tackifiers.

At elevated temperatures during service, the bismuth carboxylate will dissociate resulting in the plating of bismuth on the working part. The grease has excellent film strength, providing a rating of about 55 on the Timken rating scale. This compares with a Timken rating generally in the range of about 25 for a typical food grade grease. Due to the unique extreme pressure characteristics of the grease of the invention, the film strength, which is the pressure required to break the lubricating film, is very high, allowing for less metal-to-metal contact of bearing surfaces. Thus, the use of the grease substantially increases the service life of equipment and results in less down time.

The grease also has excellent "anti-washout" capabilities. Due to the improved "anti-washout properties", the frequency of re-lubrication is decreased.

The food grade grease incorporating a vegetable oil such as soy bean oil is also environmentally friendly and thus minimizes pollution of the environment when a portion of the grease may be flushed away with the wash water.

Other objects and advantages will appear during the course of the following description.

DESCRIPTION OF THE PREFERRED EMBODIMENT

In general, the grease composition of the invention includes an oil base, a thickener, and bismuth. The grease composition has the following formulation in weight percent:

| | |
|---|---|
| Oil base | 50%–95% |
| Thickener | 3%–30% |
| Bismuth | 0.01%–10% |

The oil can be a petroleum-based oil, such as a naphthenic or paraffinic oil, a synthetic oil base stock, or silicon oil. As a food grade grease, the oil takes the form of a vegetable oil such as soy bean oil, canola, palm oil, rape seed oil, jojoba or the like.

With a food grade grease composition, the preferred thickener is a food grade bentonite clay, such as Baragel 3000 sold by Rheox, Inc. of Hightstown, N.J. Other food grade thickeners that can be used are lanolin polymers, oxidized high molecular weight polyethylene with an acid value of 30 to 40, and oxidized polyalphaolefins. For a non-food grade grease, the thickener can take the form of a lithium soap, polyurea, silica, amorphous polyolefins, wool greases, pentaery thritol ester/calcium salt, or the like. The thickener provides the desired thickening for the oil base, and the lithium soap, if employed, also provides some lubricity for the composition.

The bismuth is preferably employed in the form of a bismuth carboxylate that contains 6 to 16 carbon atoms in the carboxyl radical. Specific examples of bismuth carboxylates which can be used in the grease composition are bismuth neodecanoate, bismuth 2-ethylhexanoate, bismuth naphthenate, and the like.

As the bismuth carboxylate is very viscous, it is preferred to premix the bismuth carboxylate with an organic liquid diluent or carrier which thins out the carboxylate and provides a pourable liquid. The carrier, which can be used with the bismuth carboxylate, includes mineral spirits, mineral oil, vegetable oil, neodecanoic acid, oxtanoic acid, and the like.

While the bismuth carboxylate is the preferred bismuth additive, bismuth metal in finely divided powder form can also be utilized.

As optional ingredients, the grease composition can also include up to 5.0% of an anti-oxidant or preservative, such as BHT (butyl hydroxy toluene), which serve to prevent oxidation or decomposition of the oil base. Metal corrosion inhibitors, up to 5.0% by weight, can also be incorporated in the composition to inhibit corrosion of the metal components to which the grease is applied. Examples of typical corrosion inhibitors that can be used are 1-DSSG sold by Ciba-Giegy or Elco 148 sold by Elco Corp.

In addition, the grease composition can also include up to 12% of a filler or whitening agent, such as calcium carbonate or titanium dioxide. The whitening agent is particularly useful where the grease is to be used with equipment for processing or manufacturing fabric and will prevent staining of the fabric.

In addition, the grease composition can also contain up to 5% of a tackifier, such as a synthetic liquid rubber, which aids in adherence of the grease to the working surface and improves the "anti-washout" properties. It is also contemplated that polytetrafluoroethylene can be added in an amount up to 6.0% and can provide friction reduction beyond that of the bismuth coating on the working, elements. Also, sulfur compounds, such as Additin RC 2515 made by Rhein Chernie in an amount up to 5% by weight can be included to provide added extreme pressure characteristics.

In preparing a food grade grease of the invention, the thickener, such as bentonite clay, is initially added to the oil base and mixed with the oil. Following this, the other solid ingredients, such as calcium carbonate and/or titanium dioxide, and the corrosion inhibitor, are added to the mixture which is then heated to a temperature of about 90° F. to provide a gel. the other ingredients, such as the tackifier and anti-oxidant, are added as a melted liquid to the gel and mixed for a period of about ten minutes. Subsequently, the bismuth carboxylate, preferably in the form of a pourable premix with a liquid carrier, is added to the gel. The entire mixture is then milled, which provides shearing action to create the finalized homogenized gel. The product can then be packaged.

Depending on the type of oil base and thickener, the temperatures and milling gaps or pressures can vary.

As a food grade grease, the composition of the invention has distinct advantages over prior food grade greases. The grease of the invention, depending on the thickener used, may have no dropping point, which means that the oil does not separate out at high temperatures.

Further, the food grade grease has improved film strength with a Timken scale rating of about 55, which is substantially higher than typical food grade greases.

The grease composition of the invention also has improved water resistance or "anti-washout" properties so that the grease will not readily wash away with a sanitizing solution. This results in less frequent re-lubrication of the equipment being necessary.

The food grade grease of the invention is also environmentally friendly so that any grease which is washed away with the wash solution when cleaning food processing equipment will readily degrade and not present an environmental problem.

A specific example of a food grade grease made in accordance with the invention is as follows in weight percent:

| | |
|---|---|
| Soy bean oil | 68.30% |
| Baragel 3000 (bentonite clay) | 15.00% |
| Calcium carbonate | 10.00% |
| I-DSSG (corrosion inhibitor) | 0.75% |
| Titanium dioxide | 0.75% |
| BHT (anti-oxidant) | 1.00% |
| Heveatex 1501 (tackifier) | 0.20% |
| Bismuth neodecanoate | 3.50% |

In preparing the above composition, the Baragel 3000 bentonite clay was added to the soy bean oil and mixed therein at a speed of 450 rpm. The calcium carbonate, I-DSSG and titanium dioxide were then added to the mixture and the mixture was heated to 90° F. The BHT was then melted and added to the mixture along with the tackifier. The bismuth neodecanoate was then added to the heated mixture and the entire mixture was milled at a 0.002 inch gap set to provide a homogeneous gel or grease.

A second example of a non-food grade grease composition was prepared having the following composition in weight percent:

| | |
|---|---|
| Petroleum oil | 80% |
| Lithium soap | 11% |
| Heveatex 1501 (tackifier) | 0.5% |
| I-DSSG (corrosion inhibitor) | 4% |
| Bismuth 2-ethylhexanoate | 2% |

The lithium soap is added to the oil and heated to 102° F. The corrosion inhibitor and tackifier are added and mixed for about ten minutes, followed by the bismuth compound. The resulting gel is milled for ten minutes using a 0.004 inch gap to provide a homogeneous gel or grease.

I claim:

1. A lubricating grease composition comprising by weight 50%–95% of a vegetable oil base, 3%–30% of a thickener, and 0.1%–10% of a material selected from the group consisting of powdered bismuth and a bismuth carboxylate where the carboxyl radical contains from 6 to 16 carbon atoms.

2. The composition of claim 1 wherein the vegetable oil is selected from the group consisting of soy bean oil, canola oil, palm oil, rape seed oil and jajoba oil.

3. The composition of claim 1 wherein the thickener comprises bentonite clay.

4. The composition of claim 1 wherein the bismuth carboxylate is diluted with an organic liquid carrier that is miscible with said carboxylate.

5. The composition of claim 1 wherein said thickener comprises lithium soap.

6. The composition of claim 1, and including from 0%–5% of a tackifier.

7. The composition of claim 6 wherein the tackifier is a liquid compound of 0–5% rubber.

8. The composition of claim 1, and including from 0%–12% of calcium carbonate.

9. The composition of claim 1, and including form 0%–12% by weight of titanium dioxide.

10. The composition of claim 1, and including from 0%–6% of polytetrafluorethylene.

11. A lubricating grease composition comprising by weight from 50%–95% of a vegetable oil selected from the group consisting of soy bean oil, canola oil, palm oil, rape seed oil and jojoba oil, from 3%–30% of bentonite clay, and from 0.01%–10.0% of a bismuth carboxylate where the carboxylate radical contains from 6 to 16 carbon atoms.

12. The composition of claim 11 wherein said bismuth carboxylate is selected from the group consisting of bismuth neodecanoate, bismuth 2-ethylhexanoate, bismuth naphthenate, and mixtures thereof.

13. The composition of claim 11 wherein said vegetable oil comprises soy bean oil.

14. The composition of claim 11, and including up to 5.0% by weight of a metal corrosion inhibitor.

15. The composition of claim 11, and including up to 5.0% by weight of an anti-oxidant.

16. The composition of claim 11, and including 0%–5.0% by weight of a rubber tackifier.

17. The composition of claim 11, and including up to 12.0% by weight of material selected from the group consisting of calcium carbonate, titanium dioxide, and mixtures thereof.

* * * * *